US005538249A

United States Patent [19]

Benson

[11] Patent Number: 5,538,249

[45] Date of Patent: Jul. 23, 1996

[54] GOLF PUTTER HEAD

[76] Inventor: Glenn S. Benson, 19509 Pasadena Ave., South Bend, Ind. 46614

[21] Appl. No.: 489,744

[22] Filed: Jun. 13, 1995

[51] Int. Cl.[6] ..... A63B 69/36

[52] U.S. Cl. ..... 473/254; 473/251

[58] Field of Search ..... 273/164.1, 187.4, 273/187.6, 186.1, 163 R

[56] References Cited

U.S. PATENT DOCUMENTS

| | | | |
|---|---|---|---|
| 837,030 | 11/1906 | Blanchard | 273/164.1 |
| 3,549,300 | 12/1970 | Pelz | 273/164.1 |
| 3,880,430 | 4/1975 | McCabe | 273/187.4 |
| 4,986,544 | 1/1991 | Benson | 273/187.4 |

*Primary Examiner*—George J. Marlo
*Attorney, Agent, or Firm*—R. Tracy Crump

[57] ABSTRACT

A golf putter head connectable to the shaft of a golf putter is disclosed, which allows a golfer in an "eyes over ball" stance to instantly and accurately visually determine if his hand position on the putter places the sole of the putter parallel to the putting surface. The putter head includes an elongated body and a hosel for connecting the body to the putter shaft. The putter head body includes an upright blade that has a flat front striking face and a rear face, weighted heel and toe ends that protrude from the blade's rear face, and a flat horizontal flange that extends along the lower edge of the blade's rear face between the heel and toe ends. The flange has a raised strip or marker that extends perpendicularly to the front striking face. The putter head also includes a protrusion, which extends outwardly form the blade's rear face perpendicular to the strike face and includes downwardly converging side surfaces and is spaced vertically above the rear flange and raised rib. In an "eyes over ball" stance, the golfer's view of the marker is obstructed by the protrusion only when the sole of the putter head is parallel to the putting surface.

3 Claims, 5 Drawing Sheets

GOLF PUTTER HEAD

This invention relates to a golf putter head connectable to the shaft of a golf club, and in particular a golf putter head which allows a golfer in an "eyes over ball" stance to instantly and accurately visually determine if his hand position on the putter places the sole of the putter parallel to the putting surface.

BACKGROUND OF THE INVENTION

Putting is a critical aspect of the game of golf. While each golfer tends to possess his own unique style of putting, some fundamentals are universally recognized as being essential to successful putting technique. The golfer's head and eyes must be positioned directly over the ball in the vertical plane in line with the path the putter head will travel toward its target. The putting stance with the golfer "eyes over the ball" assists in accurately aligning the path of the putter head in the direction of the cup. A golfer generally relies on his own visual perception to insure that his stance positions his "eyes over the ball."

In addition, the golf ball must be contacted at the center of gravity or "sweet spot" of the striking face of the putter head, and the sole of the putter head must be parallel to the putting surface. The angle of the putter's shaft determines whether the sole of the putter head is parallel to the putting surface. The position of a golfer's hands relative to a horizontal plane generally at or about his belt line can vary the angle of the putter shaft thereby affecting the position of the putter head with respect to the putting surface. If the golfer's hand position is too low relative to this plane, the toe of the putter head will be raised higher than the heel and the sole of the putter head will not be parallel to the putting surface. If the golfer's hand position is too high relative to this plane, the heel of the putter head will be raised higher than the toe and again the sole of the putter head will not be parallel to the putting surface. If the sole of the putter head is not parallel to the putting surface upon contact with the ball, its center of gravity shifts, which generates torque in the putter head.

A variety of putter heads have been developed which assist the golfer in visually determining the proper position of the putter head with respect to the ball, target line and putting surface. Some putter head designs focus on heel and toe weighting to counter off-center hits. Many conventional putter heads have markings, lines or grooves that assist the golfer in aligning the ball at the "sweet spot" of the striking face and aligning the striking face perpendicular to the target line. U.S. Pat. No. 3,880,430 issued to McCabe discloses a putter that allows the golfer to visually determine if the sole of the putter head is parallel to the putting surface. The McCabe putter includes a pair of laterally spaced parallel markings placed on a horizontal flange that extends rearwardly from the striking face and a rearward extension spaced above the flange. To achieve proper putter head alignment and positioning, the golfer must visually center the rearward extension between the two parallel markings. Consequently, the accuracy of this positioning method is dependent on the golfer's own perception of whether the extension is centered between the markings. Naturally, visually centering the extension between the markings is more difficult as the width of the extension and the lateral spacing between the markings increases. Errors in accurately centering the extension between the two markings result in the improper positioning of the putter head and mishit putts.

SUMMARY OF THE INVENTION

The putter head of this invention allows a golfer in an "eyes over ball" stance to instantly and accurately visually determine if his hand position on the putter places the sole of the putter parallel to the putting surface. The putter head of this invention includes an elongated body and a hosel for connecting the body to the putter shaft. The putter head body includes an upright portion or blade that has a flat front striking face and a rear face, weighted heel and toe ends that protrude from the blade's rear face, and a flat horizontal flange that extends along the lower edge of the blade's rear face between the heel and toe ends. The flange has a raised strip or marker that extends perpendicularly to the front striking face. The putter head also includes an alignment indicating protrusion, which extends rearwardly from the upper edge of the end wall. The protrusion extends perpendicularly to the striking face and is spaced vertically above the rear flange and raised rib. The protrusion includes tapered side walls, which converge toward the marker. The protrusion may also be used to assist the golfer in centering the ball at the "sweet spot" of the striking face and aligning the putter head with the intended path of the ball toward the cup. Preferably, the marker is colored to be visually contrasted with the color of the remainder of the putter head.

In an "eyes over ball" stance, the golfer's view of the raised rib is obstructed by the protrusion only when the sole of the putter head is parallel to the putting surface. When the toe of the putter head is raised, a portion of the raised rib becomes visible to the golfer between the protrusion and the toe portion of the putter head. When the heel of the putter head is raised, a portion of the raised rib becomes visible to the golfer between the protrusion and the heel portion of the putter. The convergent taper of the protrusion's side walls prohibit the side walls from obstructing the golfer's view of the raised rib when the sole of the putter head is not parallel to the putting surface. If the raised rib or marker is visible, the golfer knows that the putter head is not properly positioned and can make minor adjustments to his hand position on the putter. When the raised rib or marker is not visible (obstructed by the protrusion), the golfer is assured that the putter head is properly positioned. Consequently, the putter head provides instant visual feedback to the golfer for assuring proper putter head positioning, without the golfer aligning or centering the protrusion between a set of markings based on the accuracy of his own visual perception.

Accordingly, an advantage of the putter head of this invention is that the putter head enhances the golfer's ability to properly eye and position the putter head prior to the putt.

Another advantage of the putter head of this invention is that the putter head provides an instantaneous indication of proper putter head positioning without the golfer visually centering any marking based on his own visual perception.

Another advantage of the putter head of this invention is that the putter head provides visual feedback as to the orientation of the sole of the head with respect to the putting surface.

Other advantages will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

Figure 1:
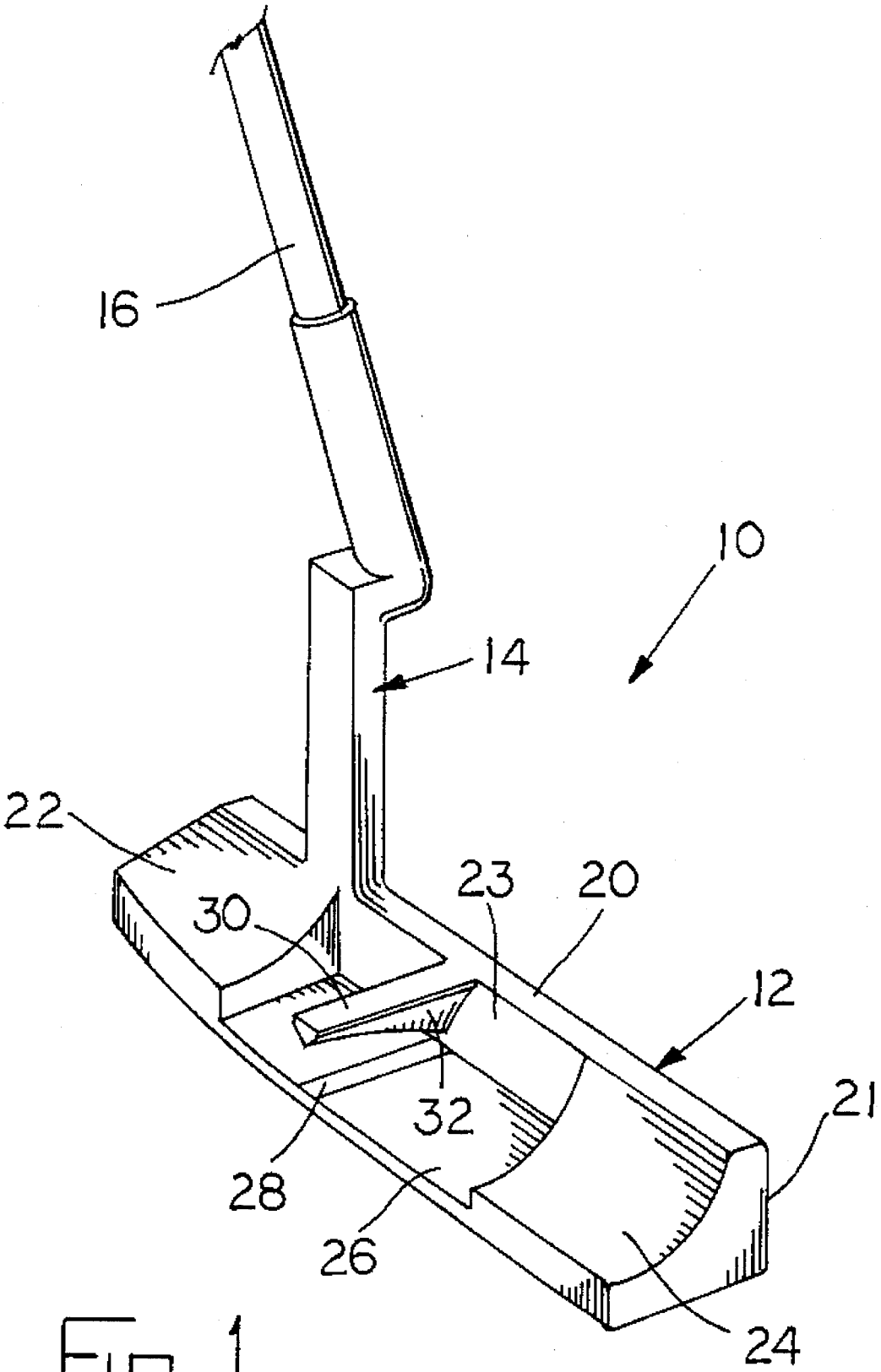
FIG. 1 is a perspective view of the putter head of this invention.

The preferred embodiment herein described is not intended to be exhaustive or to limit the invention to the precise form disclosed. It is chosen and described to best explain the invention so that others skilled in the art might utilize its teachings. FIG. 1 shows the putter head 10 of this invention. Putter head 10 is shown using a conventional weighted heel and toe design; although, the teachings of this invention can be incorporated into any conventional head design, and are not intended to be limited to any head design or configuration. As shown, putter head 10 includes an elongated body 12 and an off-set hosel 14, which connects putter head 10 to the putter shaft 16. Body 12 includes an upright portion or blade 20 that has a flat front striking face 21 and rear face 23, weighted heel and toe ends 22, 24 that protrude from rear face 23 of blade 20, and flat horizontal flange 26 that extends along the lower edge of rear face 23 between heel and toe ends 22, 24. Flange 26 has a raised strip or marker 28, which extends perpendicularly to striking face 21. Marker 28 may consist of any line, groove or any other marking or symbol formed on flange 26 which is visible to the golfer. Putter head 10 also includes a horizontal beam or protrusion 30. Protrusion 30 extends outwardly from the upper edge of rear face 23 perpendicular to striking face 21 and is spaced above flange 26 and marker 28. One skilled in the art, will note that protrusion 30 extends perpendicularly to the "sweet spot" of striking face 21. As shown in FIGS. 1, 3, 5, and 7, protrusion 30 includes tapered side walls or surface 32, which converge toward marker 28 to define a trapezoidal cross section. Preferably, marker 28 is colored to be visually contrasted with the color of the remainder of putter head 10.

Figure 2:
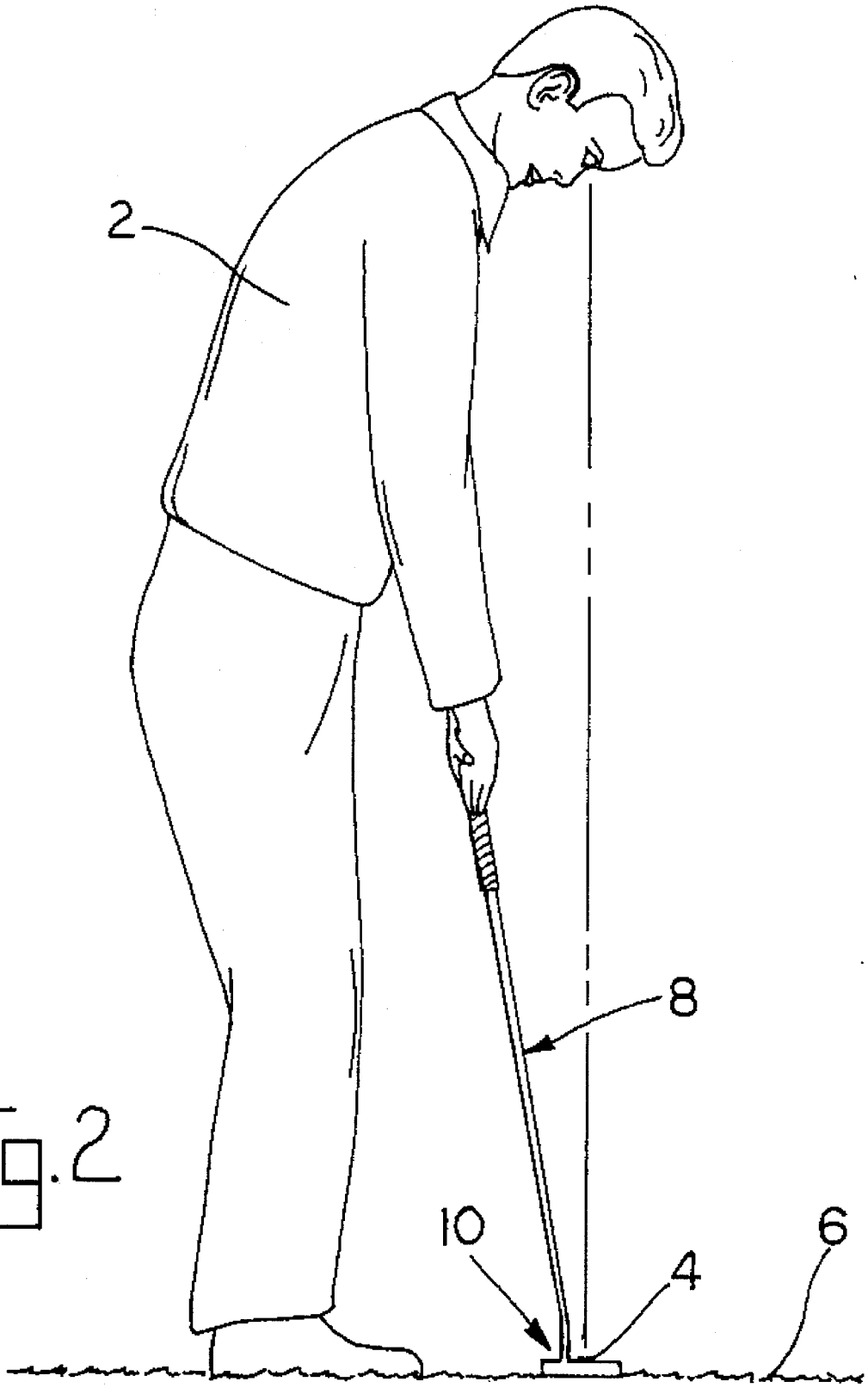
FIG. 2 is a perspective view of a golfer in an "eyes over ball" stance using a putter including the putter head of this invention addressing a golf ball.
Figure 4:
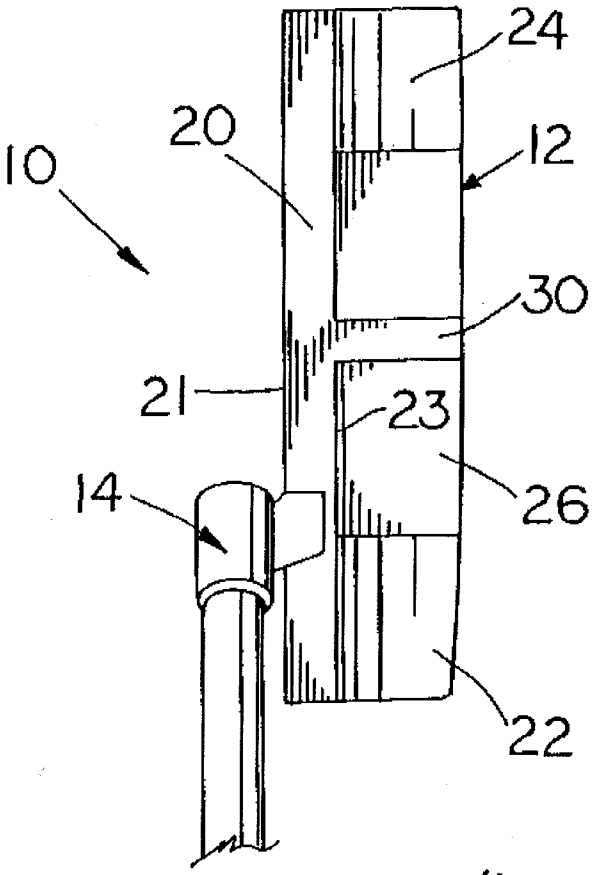
FIG. 4 is a top view of the putter head illustrating the obstruction of the golfer's view of the flange by the protrusion when the putter head is properly positioned over the putting surface.
Figure 3:
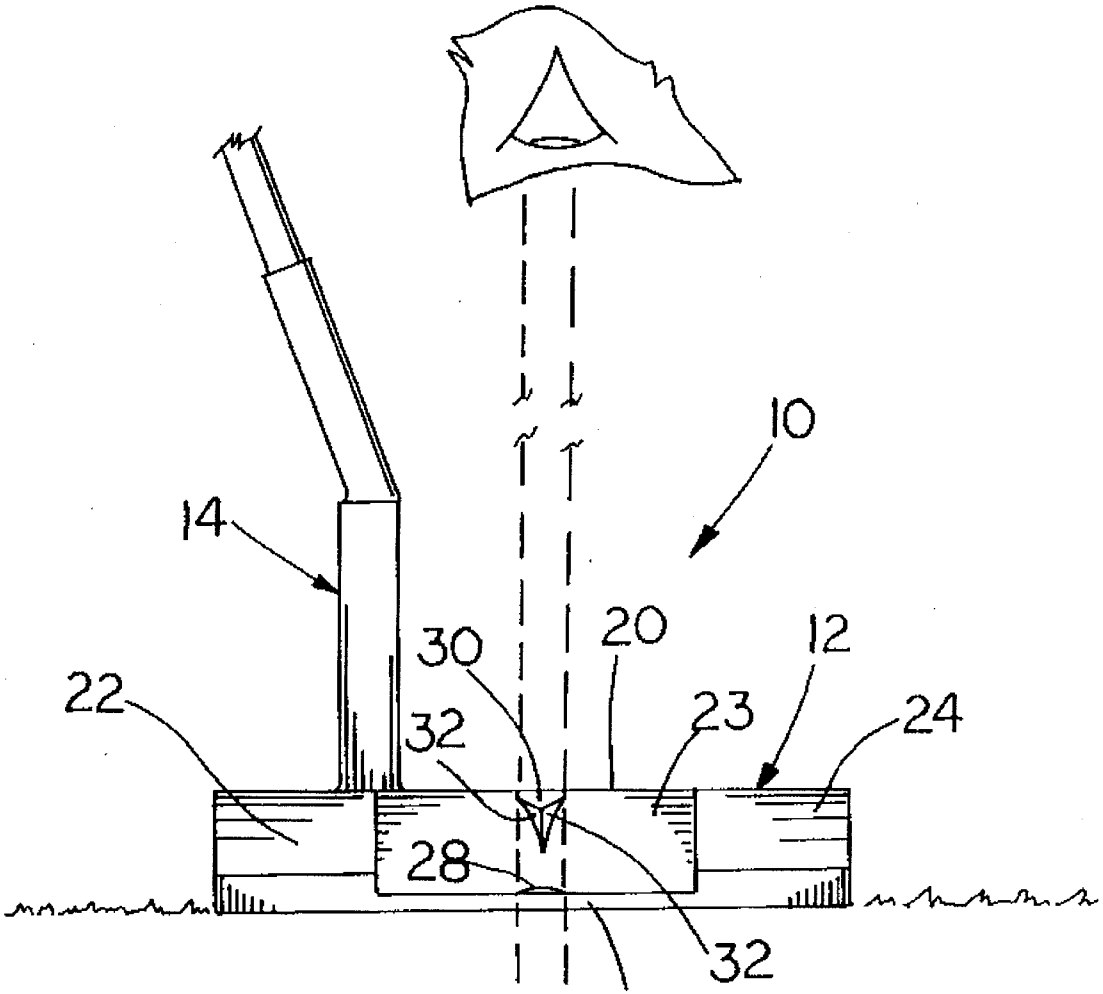
FIG. 3 is a side vide of the putter head illustrating the obstruction of the golfer's view of the flange by the protrusion when the putter head is properly positioned over the putting surface.
Figure 6:
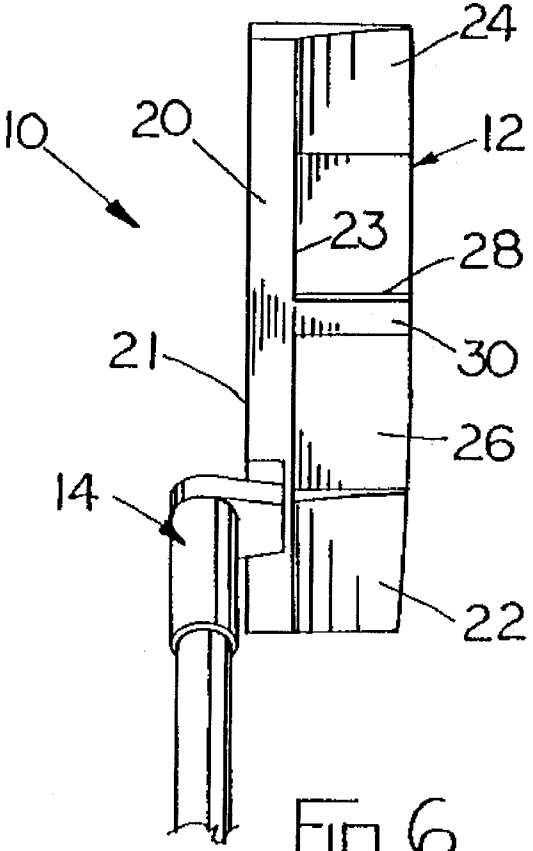
FIG. 6 is a top view of the putter head illustrating the golfer's view of the flange when the putter head is improperly positioned having a raised toe.
Figure 5:
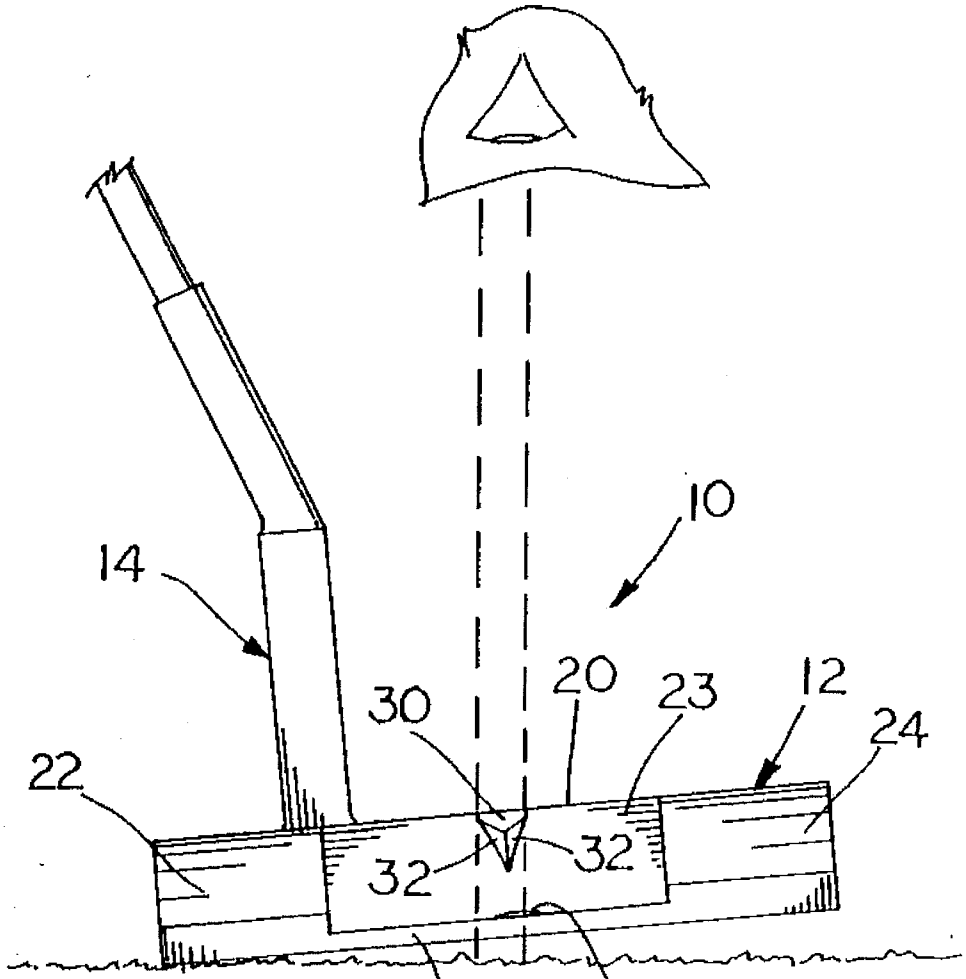
FIG. 5 is a side view of the putter head illustrating the golfer's view of the flange when the putter head is improperly positioned having a raised toe.
Figure 8:
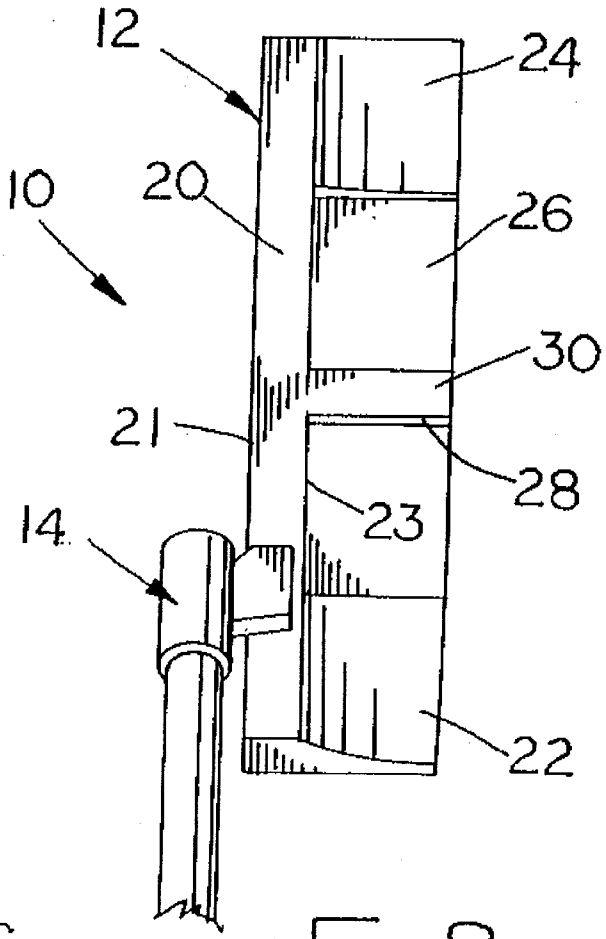
FIG. 8 is a top view of the putter head illustrating the golfer's view of the flange when the putter head is improperly positioned having a raised heel.
Figure 7:
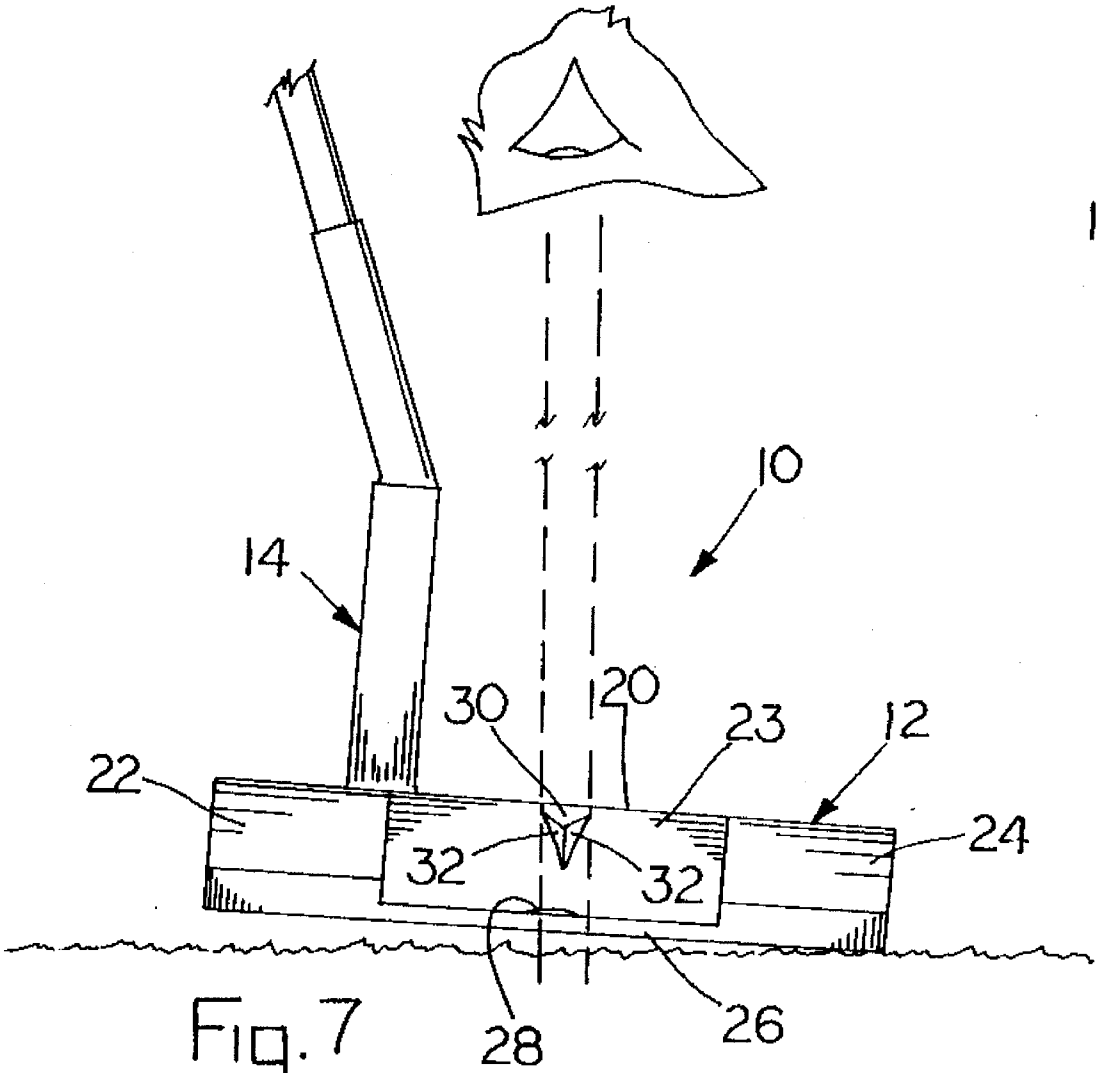
FIG. 7 is a fragmented side vide of the putter head illustrating the golfer's view of the flange when the putter head is improperly positioned having a raised heel.

FIGS. 2–8 illustrate the visual position indicating mechanism of putter head 10. FIG. 2 shows a golfer 2 addressing a golf ball 4 in an "eyes over ball" stance with a putter 8 using putter head 10 of this invention. In the "eyes over ball" stance, golfer 2 can instantly and accurately determine if his hand position places putter shaft 16 at the correct angle so that the sole of putter head 10 is parallel to putting surface 6. FIGS. 3 and 4 show putter head 10 properly positioned so that its sole is parallel to putting surface 6. In an "eyes over ball" stance, the golfer's view of marker 28 is obstructed by protrusion 30 only when the sole of putter head 10 is parallel to putting surface 6. One skilled in the art will note that the width of the upper surface of protrusion 30 is sufficient to obstruct the view of marker 28 only when the sole of putter head 10 is properly aligned and parallel to putting surface 6. Because of the distance from the golfer's eye to putter head 10, the width of the upper surface of protrusion 30 can be slightly less than the width of marker 28. When the toe of putter head 10 is raised, a portion of marker 28 becomes visible to the golfer between protrusion 30 and toe portion 24, as shown in FIGS. 5 and 6. When the heel of putter head 10 is raised, a portion of marker 28 becomes visible to the golfer between protrusion 30 and heel portion 22, as shown in FIGS. 7 and 8. The convergent taper of side walls 32 toward marker 28 prohibits the side walls from obstructing the golfer's view of the marker when the sole of putter head 10 is not parallel to putting surface 6. If the marker is visible, the golfer knows that the sole of putter head 10 is not parallel to putting surface 6 and can make minor adjustments to his hand position to correct the positioning error. When the marker is not visible (obstructed by protrusion 30), the golfer is assured that his hand position places putter shaft 16 at the correct angle to position the sole of putter head 10 parallel to putting surface 6.

It is understood that the above description does not limit the invention to the details given, but may be modified within the scope of the following claims.

I claim:

1. A putter head connectable to the shaft of a golf putter for use by a golfer to putt a golf ball along a horizontal putting surface, comprising:

an upright blade part having a front face for contacting said golf ball and a rear face, a first protrusion extending outwardly from said rear face and adjacent to the bottom edge thereof, a marker located atop said first protrusion, and a second protrusion extending outwardly from said rear face and spaced over said first protrusion, said second protrusion including a top surface and a pair of side surfaces, said side surfaces converging toward said marker from said top surface so that said top surface obstructs the view of said marker only when said blade part is parallel to said putting surface.

2. The putter head of claim 1 wherein said protrusions protrude from said rear face perpendicularly to said front face.

3. The putter head of claim 1 wherein said marker is a strip extending perpendicularly to said front face.

* * * * *